US005784745A

United States Patent [19]

Saxon et al.

[11] Patent Number: 5,784,745

[45] Date of Patent: Jul. 28, 1998

[54] EASY INSERT TUBE CLEANER

[75] Inventors: Gregory J. Saxon; Jerzy Krysicki, both of Oakmont, Pa.

[73] Assignee: Conco Systems, Inc., Verona, Pa.

[21] Appl. No.: 928,847

[22] Filed: Sep. 12, 1997

[51] Int. Cl.[6] ..... B08B 9/04

[52] U.S. Cl. ..... 15/104.061; 15/104.16

[58] Field of Search ..... 15/3.5, 104.05, 15/104.061, 104.16

[56] References Cited

U.S. PATENT DOCUMENTS 2,170,997 8/1939 Griffin ..... 15/104.061

2,418,509 4/1947 Griffin ..... 15/104.061

2,734,208 2/1956 Griffin ..... 15/104.061

4,281,432 8/1981 Saxon ..... 15/104.061

*Primary Examiner*—Mark Spisich

*Attorney, Agent, or Firm*—Armstrong, Westerman, Hattori, McLeland & Naughton

[57] ABSTRACT

A tube cleaner that provides for easy insertion into an open end of a tube has a shaft, a nose portion and tail portion, and a plurality of scraper devices secured to the shaft. The scraper devices are U-shaped and have a base and at least two leg portions which have terminal scraping sections. A tongue is provided on the leg portion which extends from the leg portion rearwardly and outwardly to a position adjacent the scraping section of the scraper device.

9 Claims, 2 Drawing Sheets

EASY INSERT TUBE CLEANER

CROSS REFERENCE TO RELATED APPLICATION

This application is related to co-pending application Ser. No. 08/928,980 filed on even date herewith in the names of the present inventors, and entitled "Easy Insert Composite Tube Cleaner", which application is assigned to the assignee of the present application.

FIELD OF THE INVENTION

The present invention is to a tube cleaning device for use in cleaning the inner wall of a tube or conduit, and more specifically to a tube cleaner that is insertable into an open end of a tube, such as a condenser tube, and forced through the tube by a fluid, such as water, discharged from pressurized fluid gun to remove deposits on the inner wall surface of the tube.

BACKGROUND OF THE INVENTION

In the cleaning of the inner wall of tube, such as condenser tubes, in power plants, to improve the efficiency of heat transfer therethrough, a resilient scraping tool is inserted into an open end of the tube and a pressurized fluid is charged to the open end of the tube to propel the scraping tool through the tube. During passage through the tube, the scraping tool scrapes deposits from the inner wall of the tube and discharges the deposits from the other end of the tube. Such tube cleaners have been used extensively and examples of typical such tube cleaners are shown, for example, in U.S. Pat. No. 2,170,997; U.S. Pat. No. 2,418,509; U.S. Pat. No. 2,734,208, and U.S. Pat. No. 4,281,432. These tube cleaners use scraping elements that are spaced along a shaft, with scraping blades of adjacent scraping elements offset from each other so that the deposits on the inner tube wall are scraped away along the entire 360 °inner circumference thereof. The scraper elements, with the scraper blades, are usually formed from steel and are flexible enough to be inserted into the open end of a tube while making contact with and removing deposits from the tube wall upon passage through the tube.

It is an object of the present invention to provide a tube cleaner which is more easily inserted into an open end of a tube to be cleaned.

SUMMARY OF THE INVENTION

The easy insert tube cleaner of the present invention has a shaft with a nose portion at the front end, a tail portion at the rear end, and a plurality of spaced scraper devices between the nose portion and tail portion. The scraper device is a U-shaped scraper having a base and at least two leg portions, with each leg portion extending in the direction of the tail portion of the tube cleaner. Scraping sections are provided on the terminal ends of the leg portions of the scraper device which extend radially outwardly from the shaft of the tube cleaner. A tongue is provided on the leg portion of the scraper device which extends from the leg portion rearwardly and outwardly to a position adjacent a scraping edge of the scraping section of the scraper device. The tongue is preferably a section partially cut from the leg portion of the scraper device and bent outwardly so as to be outwardly and rearwardly extending.

BRIEF DESCRIPTION OF THE DRAWINGS

The easy insert tube cleaner of the present invention will be more readily understood by reference to the following description and the accompanying drawings, wherein.

DETAILED DESCRIPTION

The tube cleaner of the present invention is constructed so as to enable easy insertion into an open end of a tube, such as a condenser tube, that is to be cleaned. The tube cleaner is made of a metal such as carbon steel or stainless steel which provides sufficient strength and resiliency to scrape deposits from the inner wall of a tube through which the tube cleaner is passed.

Figure 1:
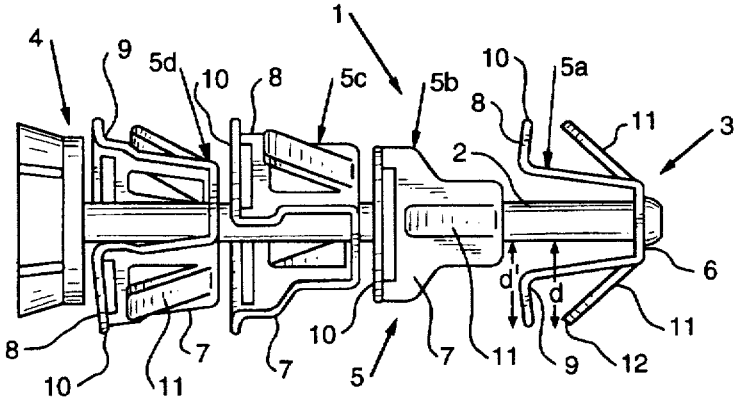
FIG. 1 is a side elevational view of an embodiment of an easy insert tube cleaner of the present invention.
Figure 2:
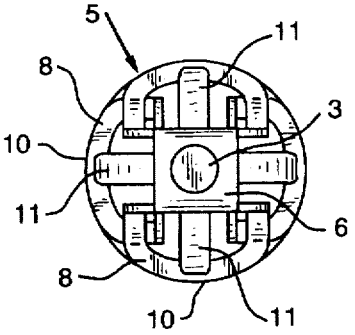
FIG. 2 is a front view of the easy insert tube cleaner of FIG. 1.
Figure 3:
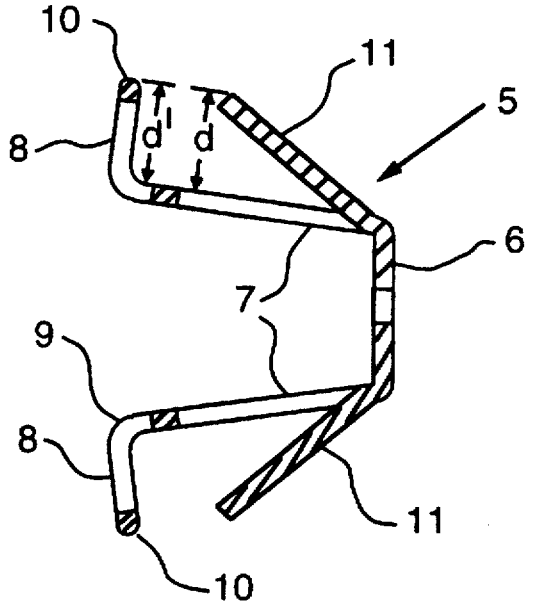
FIG. 3 is a cross-sectional view through one of the scraper devices used on the easy insert tube cleaner shown in FIG. 1.

Referring now to the drawings, an easy insert tube cleaner 1 is shown that has shaft 2 with a nose portion 3 at the front end and a tail portion 4 at the rear end thereof. The nose portion 3 may have a rivet head which secures scraper devices on the shaft 2, while the tail portion 4 is adapted to provide a surface for impingement of pressurized fluid thereon to drive the tube cleaner through a tube, as known in the art. A plurality of scraper devices 5, shown as four scraper devices, 5*a*, 5*b*, 5*c* and 5*d* in FIG. 1, are spaced along the shaft 2 between the nose portion 3 and tail portion 4. The scraper devices 5 are U-shaped and have a base 6 and at least two leg portions 7 which extend in the direction of the tail portion 4 of the easy insert tube cleaner 1 and have a scraping section 8 at the terminal end 9 of the leg portion 7 which scraping section 8 has a scraping edge 10. The scraper devices 5 are positioned along the shaft of the easy insert tube cleaner 1 in a manner such that the leg portions 7 and scraping edges 10 of adjacent scraper devices 5 are offset from each other. Such positioning is known in the art so as to provide scraping completely around the circumference of a pipe internal surface.

In the present easy insert tube cleaner 1, a tongue 11 is provided on the leg portion 7 of the scraper device 5, which tongue extends from the leg portion rearwardly and outwardly to a position adjacent the scraping edge 10 of the scraping section 8 of the scraper device 5. As shown in the drawings, the tongue 11 extends outwardly from the leg portion 7 and has an outer edge 12, which is spaced a distance d from the shaft 2 which is substantially equal to, but less than the distance $d^1$, which is the distance of the scraping edge 10 or the scraping section 8 from the shaft 2 of the easy insert tube cleaner 1. Preferably, the outer edge of the tongue 11 is a distance d which is about 0.010 inch less than the distance $d^1$.

The tongue 11 is readily formed by stamping the same out of the metal substrate that forms the leg portion 7 of the scraper device 5.

Figure 4:
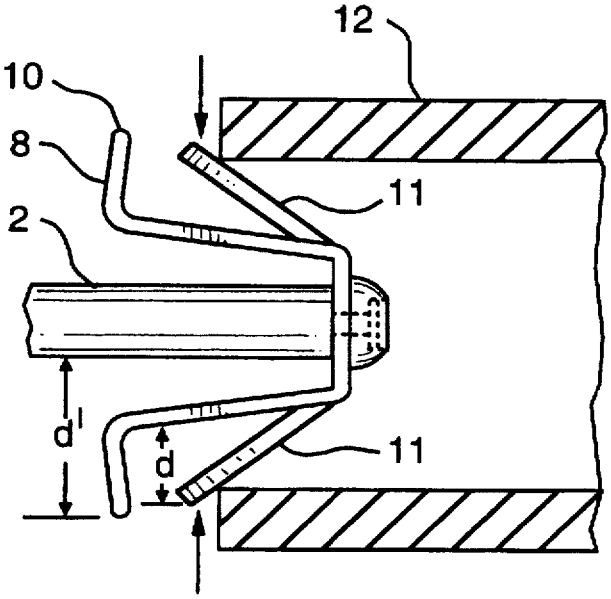
FIG. 4 is a view showing insertion of the easy insert tube cleaner of the present invention into the open end of a tube to be cleaned.

The provision of the tongue 11 on the leg portion 7 of the scraper device 5, causes the leg portions 7 to bend inwardly upon insertion into a tube 12, as indicated by the arrows in FIG. 4, and thus forces the leg portions 7 to move together and provides for a less severe contact with the scraping section 8 of the tube cleaner 1 with the end wall of the tube. By thus moving the leg portions 7 together, easier insertion of the tube cleaner 1 into an open end of a tube is effected.

What is claimed is:

1. A tube cleaner comprising a shaft having a nose portion at a front end and tail portion at a rear end thereof; and a plurality of spaced scraper devices secured to the shaft intermediate the nose portion and tail portion, each said scraper device comprising a U-shaped scraper having a base and at least two leg portions, said leg portions extending in the direction of said tail portion and having scraping sections extending outwardly from a terminal end thereof; and a tongue on each said leg portion extending therefrom rearwardly and outwardly to a position adjacent the scraping section of the respective leg portion.

2. The tube cleaner as defined in claim 1 wherein each scraping section has a scraping edge and each tongue has an outer edge, with said outer edge of each tongue spaced a distance from said shaft which is substantially equal to but less than the distance of the respective scraping edge from said shaft.

3. The tube cleaner as defined in claim 1 wherein each scraper device is formed from steel and each tongue is punched out of the respective leg portion.

4. The tube cleaner as defined in claim 1 wherein each scraper device is formed of carbon steel.

5. The tube cleaner as defined in claim 1 wherein each scraper device is formed of stainless steel.

6. The tube cleaner as defined in claim 4 wherein each tongue has an outer edge which is spaced a distance from said shaft which is substantially equal to but less than a distance of a scraping edge of the respective scraping section from said shaft.

7. The tube cleaner as defined in claim 6 wherein the outer edge of each tongue is spaced about 0.010 inch from the scraping edge of the respective scraping section.

8. The tube cleaner as defined in claim 1 wherein each tongue is formed by punching the same from the respective leg portion.

9. A tube cleaner comprising a shaft having a nose portion at a front end and tail portion at a rear end thereof; and a plurality of spaced scraper devices secured to the shaft intermediate the nose portion and tail portion, each scraper device comprising a U-shaped scraper having a base and at least two leg portions, said leg portions extending in the direction of said tail portion and having scraping sections extending outwardly from a terminal end thereof and each scraping section having a scraping edge; and a tongue on each said leg portion extending therefrom leg rearwardly and outwardly to a position adjacent the scraping section of the respective leg portion, each tongue having an outer edge which is spaced a distance from said shaft which is substantially equal to but less than the scraping edge of the respective scraping section.

* * * * *